US005407247A

United States Patent [19]

Forcier et al.

[11] Patent Number: 5,407,247

[45] Date of Patent: Apr. 18, 1995

[54] LUMBAR SUPPORTING SEAT CUSHION

[76] Inventors: Robert A. Forcier; Marsha M. Forcier, both of 2448 N. Rose St., Mesa, Ariz. 85213

[21] Appl. No.: 110,815

[22] Filed: Aug. 23, 1993

Related U.S. Application Data

[63] Continuation-in-part of Ser. No. 884,163, May 18, 1992, Pat. No. 5,288,135.

[51] Int. Cl.[6] ..... A47C 27/14; A47C 7/02; A47C 15/00

[52] U.S. Cl. ..... 297/229; 297/230.1; 297/255; 297/352; 297/452.15

[58] Field of Search ..... 297/229, 219.1, 230.1, 297/254, 255, 352, 452.15; 5/653

[56] References Cited

U.S. PATENT DOCUMENTS

| | | | |
|---|---|---|---|
| 3,233,885 | 2/1966 | Probst | 297/452.15 |
| 3,669,496 | 6/1972 | Chisholm | 297/452.15 |
| 4,190,918 | 3/1980 | Harvell | 297/219.1 |
| 4,418,958 | 12/1983 | Watkin | 297/452.15 |
| 4,457,032 | 7/1984 | Crarke | 297/219.1 |
| 5,018,790 | 5/1991 | Day | 5/653 |

*Primary Examiner*—Alexander Grosz
*Attorney, Agent, or Firm*—Jordan M. Meschkow; Lowell W. Gresham

[57] ABSTRACT

A seat cushion for prolonged sitting, having a thigh cushion coupled to and spaced apart from a back cushion. A seat well is defined between the thigh cushion and the back cushion to remove pressure from the buttocks region. Coupling members couple the thigh cushion and the back cushion, and extend therebetween on either side of the seat well.

11 Claims, 2 Drawing Sheets

LUMBAR SUPPORTING SEAT CUSHION

This is a Continuation-In-Part of application Ser. No. 07/884,163, filed 18 May 1992, now U.S. Pat. No. 5,288.135.

BACKGROUND OF THE INVENTION

1. Field of the Invention

This invention relates to cushion support apparatus.

More particularly, the present invention relates to seating devices which support various parts of the body and reduce pressure exerted on other parts.

In a further and more specific aspect, the present invention concerns providing a supporting cushion for persons seated for extended periods of time, reducing stress on the back and pressure on the buttocks region.

2. Prior Art

Persons who remain seated for extended periods of time or who have a long term immobility which confines them to a wheelchair are highly susceptible to pressure related problems such as decubitus ulcers. These ulcers generally occur on bony portions of the body where the tissue covering is relatively thin. Decubitus ulcers result from prolonged pressure on the thin body tissues which cause reduced blood flow to those tissues.

Other less serious problems may also occur to those persons who remain seated for extended periods of time on a more or less voluntary basis. Specifically, persons attending sporting or other spectator events requiring prolonged sitting on stadium seating or bleachers, may develop discomfort due to bruising of the buttocks region and/or muscle strain. Stadium seats tend to be hard and unyielding, causing the bruising or at least discomfort to the buttocks region over a prolonged period. Furthermore, while many stadium seats have seat backs, they are unsatisfactory for providing back support and promoting proper seating posture, resulting in muscle fatigue and strain.

In the prior art, seating devices have been developed which attempt to minimize the pressure on body prominences. These prior art cushions include softer foam, gels, doughnut inflatable rings, and geometries which remove cushion material in areas directly associated with these prominences. While these prior art cushions may have some success in reducing pressures to the sensitive areas, many do not provide back support in combination with the pressure reducing means. Prior art cushions rely on a very delicate balance of the front legs acting as levers, the cushions providing the fulcrum for the lever and the rear portion of the cushion providing a very soft pressure. Without back support, this lever mechanism does not always work and may result in excessive back pressure. Also, since many of the prior art cushions require mechanical contact with the most sensitive areas, moisture and heat build up naturally occurs and may result in accelerated tissue break down problems with extensive use.

It would be highly advantageous, therefore, to remedy the foregoing and other deficiencies inherent in the prior art.

Accordingly, it is an object of the present invention to provide a new and improved seat cushion.

Another object of the present invention is to provide a seat cushion which can be used on a wide variety of seating devices such as chairs, bleachers and wheelchairs.

A further object of the present invention is to provide a seat cushion which will alleviate pressure related problems to the buttocks area.

And another object of the present invention is to provide a seat cushion which distributes the body weight over the thighs and back of an individual.

Still another object of the present invention is to provide a seat cushion which supports the lumbar region of the back.

Yet another object of the present invention is to provide a seat cushion which removes all pressure from the buttocks region while still allowing for some lateral movement of an individual.

Yet still another object of the present invention is to provide a seat cushion which allows air movement around the buttocks area, reducing moisture and heat build up.

A further object of the present invention is to provide a seat cushion having a seat well for collecting waste when used by individuals unable to control evacuative functions.

Another object of the present invention is to provide a seat cushion with an adjustable seat.

And yet a further object of the present invention is to provide a seat cushion which is removably installable and portable.

SUMMARY OF THE INVENTION

Briefly, to achieve the desired objects of the instant invention in accordance with a preferred embodiment thereof, provided is a thigh cushion coupled to and spaced apart from a back cushion by coupling members. A seat well is defined between the thigh cushion and the back cushion, and bounded on both sides by coupling members. A lumbar support extends from the back cushion, providing correct posture for proper cushion operation. The buttocks area of an individual depends downward into the seat well, supported between the thigh cushion and the lumbar support.

In a further embodiment, a seat cushion is provided which includes a unitary, normally generally planar sheet of flexible cushioning material with an opening formed therein, configuring the sheet into a back cushion, a thigh cushion and coupling members coupling the back cushion to the thigh cushion.

In yet another embodiment, provided is an auxiliary cushion having coupling means for adjustably coupling it to the thigh cushion.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
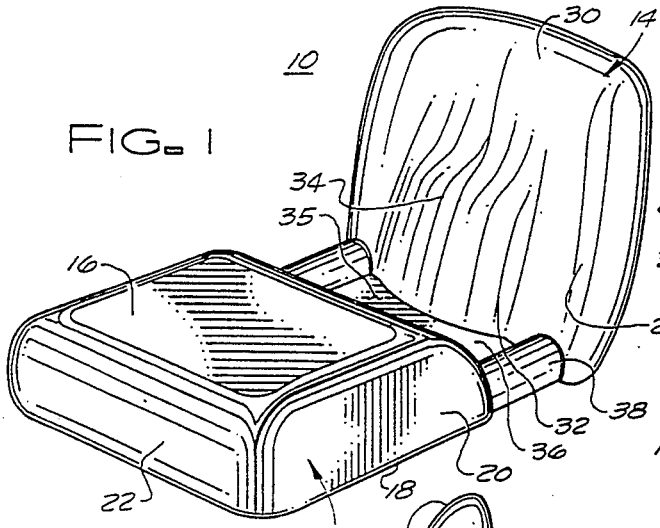
FIG. 1 is a perspective view of a seat cushion, constructed in accordance with the teachings of the instant invention.
Figure 7:
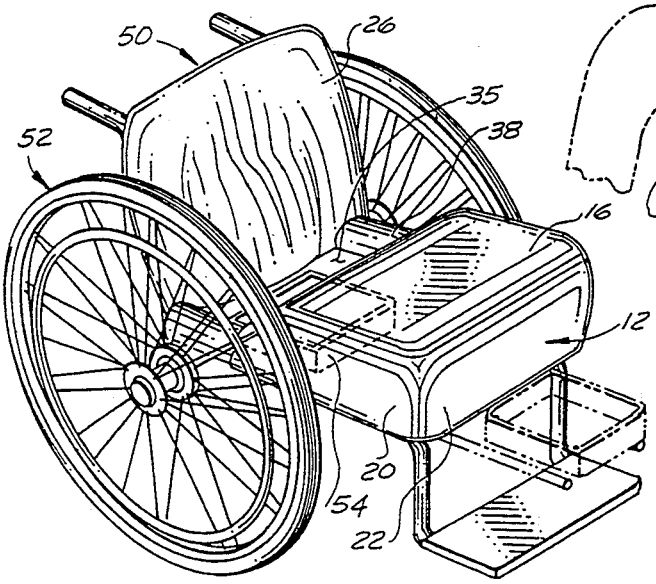
FIG. 7 is a perspective view illustrating an alternate embodiment of a seat cushion.

Turning now to the drawings in which like reference characters indicate corresponding elements throughout the several views, attention is first directed to FIG. 1 which illustrates a seat cushion generally designated 10. Seat cushion 10 can be used in a wheelchair, as depicted in FIG. 7, or any other conventional chair. Preferably, seat cushion 10 includes a thigh cushion 12 and a back cushion 14 coupled to thigh cushion 12 in a spaced apart relationship by coupling members. Thigh cushion 12 includes a top wall 16, an opposing bottom wall 18, opposing side walls 20, a front wall 22 and a rear wall 24. Back cushion 14 includes a front surface 26 and opposing back surface 28 a top portion 30 and a bottom portion 32. Front surface 26 of back cushion 14 is contoured to provide support for an individual's lower back. A compression portion 34 extends outward from bottom portion 32, and slopes inwardly at a point located medially between top portion 30 and bottom portion 32. Top portion 30 may be rounded outward on front surface 26, to function as a lumbar support.

Figure 3:
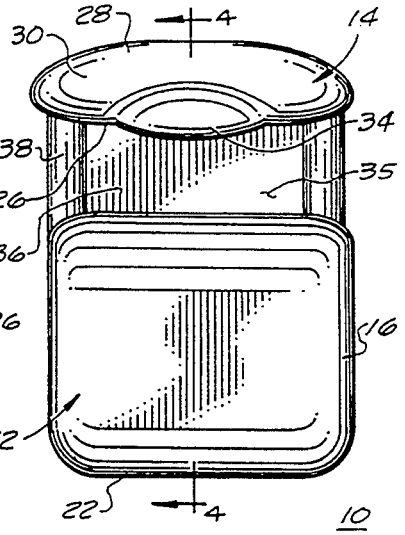
FIG. 3 is a top perspective view of the seat cushion illustrated in FIG. 1.
Figure 2:
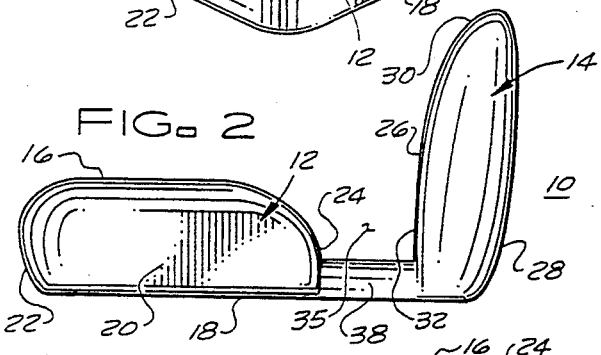
FIG. 2 is a perspective side view of the seat cushion illustrated in FIG. 1.
Figure 4:
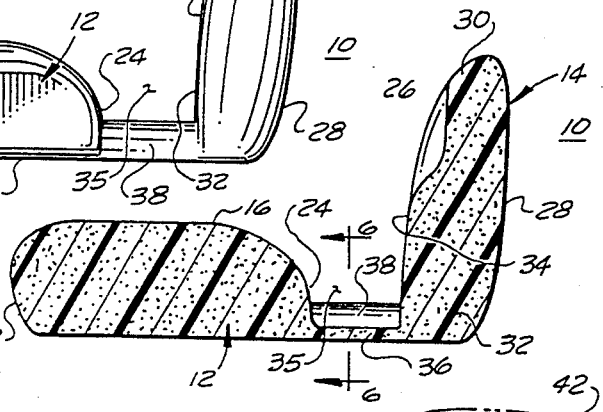
FIG. 4 is a cut-away side view taken along line 4—4 of FIG. 3.

A seat well 36 is formed between thigh cushion 12 and back cushion 14 and extends laterally the width of thigh cushion 12 and back cushion 14. As illustrated in FIGS. 1, 3, and 4, a well bottom 36 may extend from bottom wall 18 of thigh cushion 12, and couple to the bottom portion 32 of back cushion 14. Well bottom 36 aides in coupling back cushion 14 to thigh cushion 12. Also, since cushion 10 may be used on substantially any seating device such as a wheelchair or conventional chair, well bottom 36 also helps to protect the underlying support device.

Thigh cushion 12 is coupled to back cushion 14 by coupling members, which may, for example, be a frame extending under bottom wall 18 of thigh cushion 12 and back surface 28 of back cushion 14. While a wide variety of coupling members may be employed to couple thigh cushion 12 to back cushion 14, in the preferred embodiment, padded side ties 38 are used. Side ties 38 are cushions which extend from rear wall 24 of thigh cushion 12 proximate each of side walls 20, and couple to front surface 26 of back cushion 14 proximate bottom portion 32. Side ties 38 extend from thigh cushion 12 to back cushion 14 on both sides of seat well 35. It will be understood by those skilled in the art that other coupling members may be employed, as long as they extend between thigh cushion 12 and back cushion 14 without obstructing seat well 35.

Figure 5:
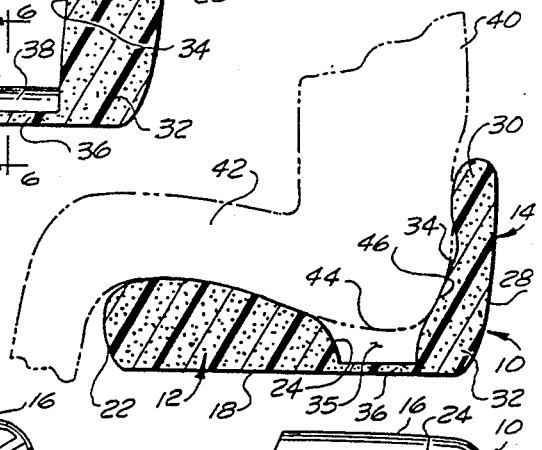
FIG. 5 is a cut-away side view similar to the view shown in FIG. 4, in use by an individual illustrated by broken lines.
Figure 6:
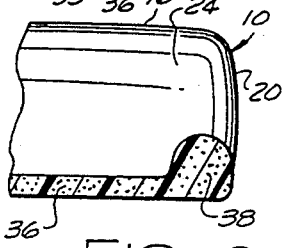
FIG. 6 is a partial cut-away view taken along line 6—6 of FIG. 4.

Referring now to FIG. 5, an individual illustrated by broken lines 40 is shown seated on seat cushion 10. Seat cushion 10 provides three point suspension, utilizing a lumbar support area in back cushion 14, and thigh support areas in thigh cushion 12. An individual's thighs 42 are supported by thigh cushion 12, allowing the buttocks region 44 to depend downward into seat well 35. A tailbone area 46 of an individual 40 presses against and compresses compression portion 34. Compression portion 34, together with top portion 30 of back cushion 14, which acts as a lumbar support, provides the third suspension point. The three point suspension together with seat well 35 provides substantially zero pressure in the buttocks region, eliminating pressure related problems, and increasing air circulation to reduce heat and moisture build-up. Seat cushion 10 will generally be used with a support structure such as a chair, which will have a back extending upwardly behind back cushion 14. This back (not shown) will typically extend upward past back cushion 14, supporting the upper back and shoulders of individual 40.

Referring now to FIG. 7, a second embodiment generally designated 50 is illustrated. In this embodiment, seat cushion 50 is substantially identical to seat cushion 10, with the exception of well bottom 36 being absent. Since an individual's buttocks depend downward into seat well 35, and ideally does not contact well bottom 36, this element may be eliminated. With the elimination of well bottom 36, embodiment 50 can be used in combination with a wheelchair frame 52. A waste tray 54 can then be removably installed under seat cushion 50 positioned centrally of seat well 35. This configuration of seat cushion 50 will allow attendants caring for seat bound individuals who cannot control their excremental functions, to keep the chair and chair bound individual clean. Waste from the chair bound individual will drop through seat well 35 instead of being caught between the individual and a seat cushion. The attendant can then remove the waste simply by removing waste tray 54. The chair bound individual may wear a backless gown for modesty purposes, or similar garments which leave the buttocks area uncovered. Incontinent women could employ seat cushion 50 with seat well 35 alone, while incontinent men may require the additional use of a urinary drainage apparatus which could terminate in waste tray 54.

Figure 8:
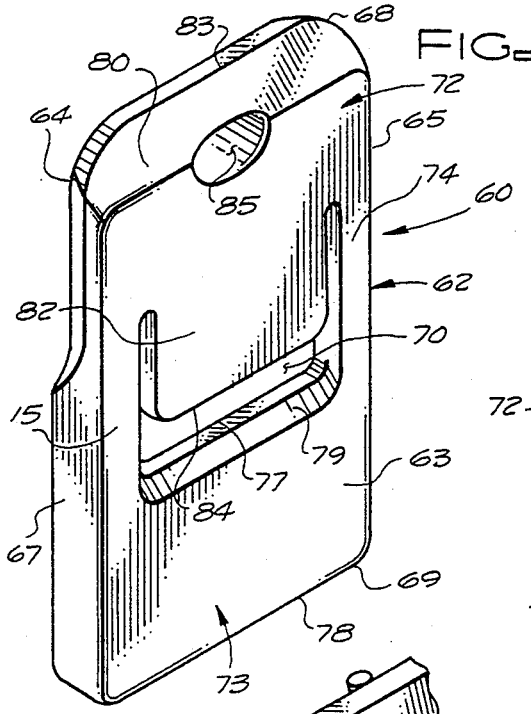
FIG. 8 is a perspective view illustrating a further embodiment of a seat cushion.

Turning now to FIG. 8, a further embodiment of a seat cushion generally designated 60 is illustrated. In this embodiment, seat cushion 60 is preferably constructed of a unitary, normally generally planar sheet 62 of flexible, cushioning material. Sheet includes a front surface 63, a back surface 64, opposing sides 65 and 67, and opposing ends, which, for purposes of orientation will be considered top end 68 and bottom end 69. An opening 70 is formed through sheet 62, generally centrally between top end 68 and bottom end 69, preferably closer to top end 68 and spaced apart from sides 65 and 67. Opening 70 divides sheet 62 into a back cushion 72 and a thigh cushion 73. Back cushion 72 and thigh cushion 73 are coupled by coupling members 74 and 75 at sides 65 and 67, respectively.

Thigh cushion 73 includes an end 77 adjacent opening 70 and an opposing end 78 coincidental with bottom end 69 of sheet 62. Front surface 63 of sheet 62 has a sloping portion 79 which slopes inward toward opening 70 at end 77, providing a contour or seat well which substantially reduces or eliminates pressure in a persons buttocks region.

For purposes of clarity, and to aid in the description of seat cushion 60, back cushion 72 includes a top portion 80 and a bottom portion 82. Top portion 80 has an end 83 coincidental with top end 68 of sheet 62, and is directly coupled to thigh cushion 73 by coupling members 74 and 75. Bottom portion 82 extends between coupling members 74 and 75 from top portion 80, and terminates in an end 84, spaced apart from end 77 of thigh cushion 73.

Figure 9:
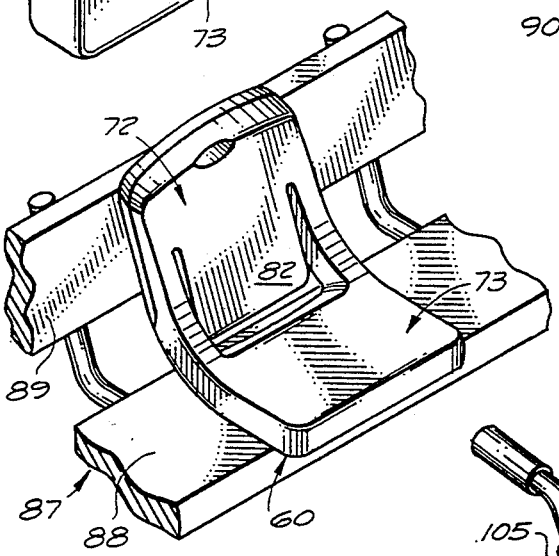
FIG. 9 is a perspective view illustrating the seat cushion of FIG. 8 as it would appear installed on a stadium seat.

Seat cushion 60 is deformable between a portable configuration and a seat configuration as illustrated in FIGS. 8 and 9 respectively. Seat cushion 60, due to the nature and flexibility of sheet 62, returns to the substantially planar portable position shown in FIG. 8 unless prevented, as discussed below. A grip opening 85 is formed through top portion 80 of back cushion 72 proximate end 83. Grip opening 85 provides an individual with a convenient handle to grip seat cushion 60 for transport.

Seat cushion 60 is deformed to the seat configuration by flexing coupling members 74 and 75 so that back cushion 72 is upright in relation to thigh cushion 73, as can be seen with reference to FIG. 9. Normally seat cushion 60 will not stay in this position, but will return to the portable position unless retained in some manner. FIG. 9 illustrates seat cushion 60 retained in the seated position by a stadium seat 87 consisting of a bench 88 with a back 89 attached thereto. Seat cushion 60 is deformed into the seat position and place with back surface 64 (not visible) at thigh cushion 73 resting on bench 88, and back surface (not visible) at back cushion 72 resting against back 89. When in the seated position, the separation between bottom portion 82 of back cushion 72 and thigh cushion 73 is increased, which along with sloping portion 79 acts as a seat well, providing increased airflow and reducing pressure on the buttocks region.

Figure 10:
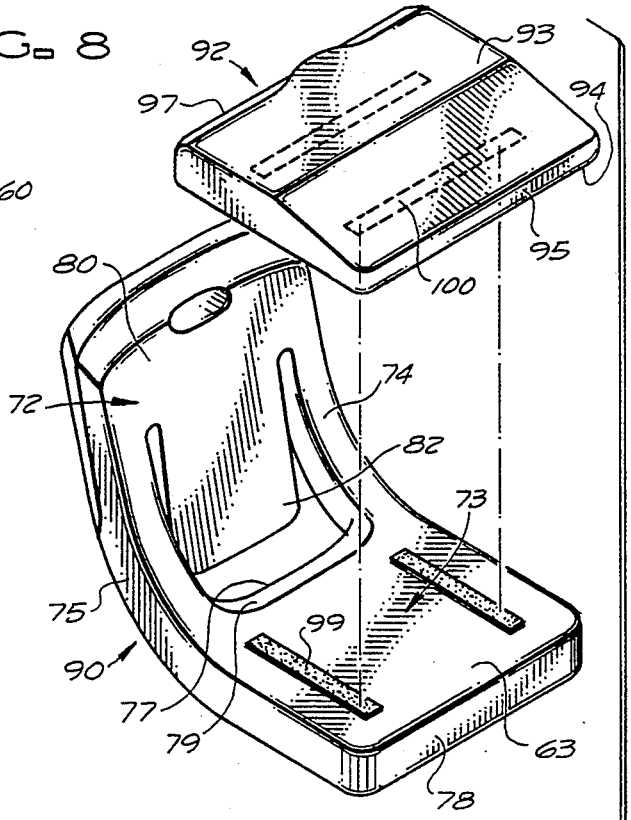
FIG. 10 is an exploded perspective view of yet a further embodiment of a seat cushion.
Figure 11:
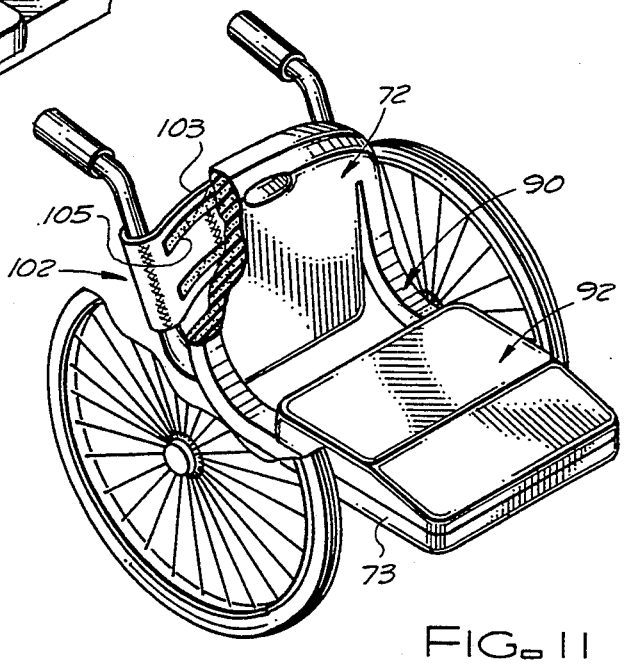
FIG. 11 is a partial cut-away perspective view illustrating the seat cushion of FIG. 10 as it would appear installed on a conventional wheelchair.

Yet a further embodiment of a seat cushion, generally designated 90, is illustrated in FIGS. 10 and 11. In general similarity to the previously described embodiment, the immediate embodiment includes in common, a sheet 62 divided by an opening 70 into a back cushion 72 and a thigh cushion 73. Other commonalities will be readily apparent to one skilled in the art.

In contrast to seat cushion 60, seat cushion 90 further includes an adjustable auxiliary cushion 92 which includes a top surface 93, an opposing bottom surface 94, a front edge 95, and a back edge 97. Auxiliary cushion 92 is adjustably and removably coupled to front surface 63 at thigh cushion 73 by coupling means. In this specific embodiment, coupling means includes elements 99 and complemental elements 100 of engagement pairs fixed to front surface 63 at thigh cushion 73 and bottom surface 94 of auxiliary cushion 92, respectively. Preferably, elements 99 and complemental elements 100 of the engagement pairs are formed from strips of material commonly known as Velcro ®. Elements 99 preferably include strips composed of the softer loop element of Velcro ®, fixed to front surface 63 at thigh cushion 73 proximate each of sides 65 and 67. Complemental elements 100 preferably include strips composed of the hook element of Velcro ®, fixed to bottom surface 94 of auxiliary cushion 92 proximate front edge 95 and back edge 97. Elements 99 and complemental elements 100 are positioned in a substantially perpendicular relationship to one another. This placement permits auxiliary cushion 92 to be positioned substantially anywhere on thigh cushion 73. Exemplary is repositioning auxiliary cushion 92 forward, with front edge 95 extending outward past edge 78 of thigh cushion 73, from a rearward position in which back edge 97 is positioned proximate edge 77 of thigh cushion 73. The adjustability of auxiliary cushion 92 permits seat cushion 90 to be adjusted to provide more leg support and permits a larger seat well to be opened between back cushion 72 and auxiliary cushion 92.

While seat cushion 90 is primarily intended to be used with auxiliary cushion 92, seat cushion 90 may be used with auxiliary cushion 92 detached, in a manner similar to seat cushion 60. In this manner, a person would sit directly on thigh cushion 73, thus the use of the loop element on thigh cushion 73, providing a softer surface than the hook element. It will be appreciated by one skilled in the art that the hook and the loop elements may be interchanged, and that the orientation of elements 99 and complemental elements 100 may be exchanged.

Referring now to FIG. 11, seat cushion 90 is shown installed in a conventional wheelchair 102, having a back 103 and a seat (not visible). Seat cushion 90 includes attachment means for attachment to wheelchair 102. In this specific embodiment, coupling means includes elements(not visible) and complemental elements 105 of engagement pairs fixed to back surface 64 at back cushion 72 and back 103 of wheelchair 102, respectively. Preferably, elements and complemental elements 105 of the engagement pairs are formed from strips of material commonly known as Velcro ®. Seat cushion 90 is secured in wheelchair 102 by coupling elements to complemental elements 105. Auxiliary cushion 92 may be adjusted as desired to accommodate a person using wheelchair 102.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A supporting seat cushion comprising a unitary, normally generally planar sheet of flexible cushioning material having a front surface and a back surface, said sheet configured into a back cushion, a thigh cushion and coupling members coupling said back cushion to said thigh cushion, and a seat well, defined by an opening wherein said sheet is deformable into a seat configuration by temporarily deforming said coupling members such that said back cushion is substantially upright with respect to said thigh cushion.

2. A seat cushion as claimed in claim 1, wherein said sheet is retained in said seat configuration by a support structure, said support structure having a seat and a substantially upright back.

3. A seat cushion as claimed in claim 2, further including an auxiliary cushion having a top surface, a bottom surface, and coupling means for adjustably and removably coupling said auxiliary cushion to said thigh cushion.

4. A seat cushion as claimed in claim 3, wherein said coupling means of said auxiliary cushion includes an element and a complemental element of an engagement pair fixed to said front surface of said sheet at said thigh cushion and said bottom surface of said auxiliary cushion, respectively.

5. A seat cushion as claimed in claim 4, wherein said element and said complemental element of an engagement pair are positioned in a substantially perpendicular relationship to one another, thereby permitting said auxiliary cushion to be adjustably positioned on said thigh cushion.

6. A seat cushion as claimed in claim 4 wherein said seat well is defined between a back edge of said auxiliary cushion and said back cushion.

7. A seat cushion as claimed in claim 4 further including attachment means for attaching said seat cushion to said support structure.

8. A seat cushion as claimed in claim 7, wherein said attachment means includes an element and a complemental element of an engagement pair fixed to said back surface of said sheet at said back cushion and said back of said support structure, respectively.

9. A supporting seat cushion for use in combination with a support structure having a seat and a substantially upright back, said seat cushion comprising:

a unitary, normally generally planar sheet of flexible cushioning material having a front surface and a back surface, said sheet configured into a back cushion, a thigh cushion and coupling members coupling said back cushion to said thigh cushion, by an opening;

an auxiliary cushion having a top surface, a bottom surface, a back edge and coupling means for adjustably and removably coupling said auxiliary cushion to said thigh cushion;

a seat well defined between said back edge of said auxiliary cushion and said back cushion; and said sheet being deformable into a seat configuration by temporarily deforming said coupling members such that said back cushion is substantially upright with respect to said thigh cushion, said sheet being retained in said seat configuration by said back and said seat of said support structure.

10. A seat cushion as claimed in claim 9, wherein said coupling means of said auxiliary cushion includes an element and a complemental element of an engagement pair fixed to said front surface of said sheet at said thigh cushion and said bottom surface of said auxiliary cushion, respectively.

11. A seat cushion as claimed in claim 10, wherein said element and said complemental element of an engagement pair are positioned in a substantially perpendicular relationship to one another, thereby permitting said auxiliary cushion to be adjustably positioned on said thigh cushion.

* * * * *